United States Patent [19]

Yato et al.

[11] Patent Number: 4,644,334

[45] Date of Patent: Feb. 17, 1987

[54] MONITORING APPARATUS FOR A CONSTRUCTION MACHINE

[75] Inventors: Tokuhiro Yato, Yawata; Yoshio Tsutsumi, Hirakata, both of Japan

[73] Assignee: Kabushiki Kaisha Komatsu Seisakusho, Tokyo, Japan

[21] Appl. No.: 824,927

[22] Filed: Jan. 31, 1986

Related U.S. Application Data

[63] Continuation of Ser. No. 420,823, Sep. 21, 1982, abandoned.

[30] Foreign Application Priority Data

Sep. 25, 1981 [JP] Japan ..... 56-151595

[51] Int. Cl.[4] ..... G08B 21/00

[52] U.S. Cl. ..... 340/679; 340/52 F; 340/53; 123/351; 123/198 DB

[58] Field of Search ..... 123/198 DB, 332, 333, 123/351; 340/679, 684, 685, 52 F, 53

[56] References Cited

U.S. PATENT DOCUMENTS

| | | | |
|---|---|---|---|
| 3,631,388 | 12/1971 | Strong | 340/52 F |
| 3,914,735 | 10/1975 | Guillaume | 340/52 F |
| 3,944,969 | 3/1976 | Arai et al. | 340/52 F |
| 3,949,356 | 4/1976 | Fuzzell et al. | 340/52 F |
| 4,034,335 | 7/1977 | Harazoe et al. | 340/679 X |
| 4,034,336 | 7/1977 | Arai | 340/52 F |
| 4,053,868 | 10/1977 | Cox et al. | 340/52 F |
| 4,067,348 | 1/1978 | Davis | 123/198 DB X |
| 4,136,329 | 1/1979 | Trobert | 340/52 F |
| 4,327,352 | 4/1982 | Cerruti | 340/52 F |
| 4,429,670 | 2/1984 | Ulanet | 123/198 DB X |

*Primary Examiner*—James L. Rowland
*Assistant Examiner*—Brian R. Tumm
*Attorney, Agent, or Firm*—Spensley Horn Jubas & Lubitz

[57] ABSTRACT

A monitoring apparatus for a construction machine having an engine includes sensors for detecting abnormality conditions at various predetermined inspection positions. A warning system, cooperating with the sensors, provides an engine idling signal and a visual display in accordance with the detected abnormality condition. A delay circuit causes the warning system to activate the visual display only if the abnormality condition continues for a predetermined time after issuance of the engine idling signal. The engine idling signal itself is provided without delay upon detection of the abnormality condition, and causes the engine to idle.

9 Claims, 11 Drawing Figures

MONITORING APPARATUS FOR A CONSTRUCTION MACHINE

This application is a continuation of U.S. Ser. No. 420,823, filed Sept. 21, 1982, now abandoned.

BACKGROUND OF THE INVENTION

The present invention relates to a monitoring apparatus for a construction machine and more particularly to an apparatus which is capable of reliably detecting an abnormality on the construction machine.

As is well known, in conventional construction machines no monitoring apparatus is provided. Usually, an operator walks around the construction machine to check how the instruments and equipments on the construction machine are properly operated before the machine starts its operation. Further, it is required that he carefully watches a variety of meters so as to check whether or not any trouble takes place with the engine and others during operation of the construction machine.

However, the conventional checking or inspecting operation prior to starting operation of the machine requires a lot of work and time. Further, it is often found that an abnormality, for instance, leakage of water from the radiator fails to be detected merely by watching the meters during operation of the machine (it should be noted that excessive leakage of water from the radiator may cause a damage of the engine). It should be added that filters are periodically replaced with new ones, because no detecting means has been heretofore available which serves to detect clogging in the filters.

Usually, a construction machine works on a rugged ground and thereby a high fluctuation is likely to occur in parameters to be checked by means of sensors, even through they are properly operated. A monitoring system was already proposed and practiced in such manner that an abnormality is detected by means of sensors which include displaying means corresponding to said sensors, but the conventional monitoring system has a drawback in that an abnormality is detected in spite of normal operation of instruments and equipment on the machine. For the this reason the conventional system is abandoned due to shortage in practicability.

There often happens in actual construction work that it is not sufficient to simply display an abnormality for some types of abnormality. In such case it is necessary to take an immediate remedial measure. In practice the engine must be restored to an idling state.

SUMMARY OF THE INVENTION

Accordingly, the present invention is intended to obviate the drawbacks as described above, and it is a principal object of the present invention to provide a monitoring apparatus which ensures reliable detecting and displaying of any abnormality on a construction machine.

It is a further object of the present invention to provide a monitoring apparatus which is constructed such that when an abnormality is detected the engine is immediately restored to an idling state for the purpose of preventing a serious damage on the engine.

Other objects and advantageous features of the present invention will be readily understood from the reading of the following description made in connection with the accompanying drawings.

BRIEF DESCRIPTION OF THE DRAWINGS

In the accompanying drawings.

DETAILED DESCRIPTION OF THE INVENTION

Now the present invention will be described in more details with reference to the accompanying drawings which illustrate preferred embodiments of the present invention.

Figure 1:
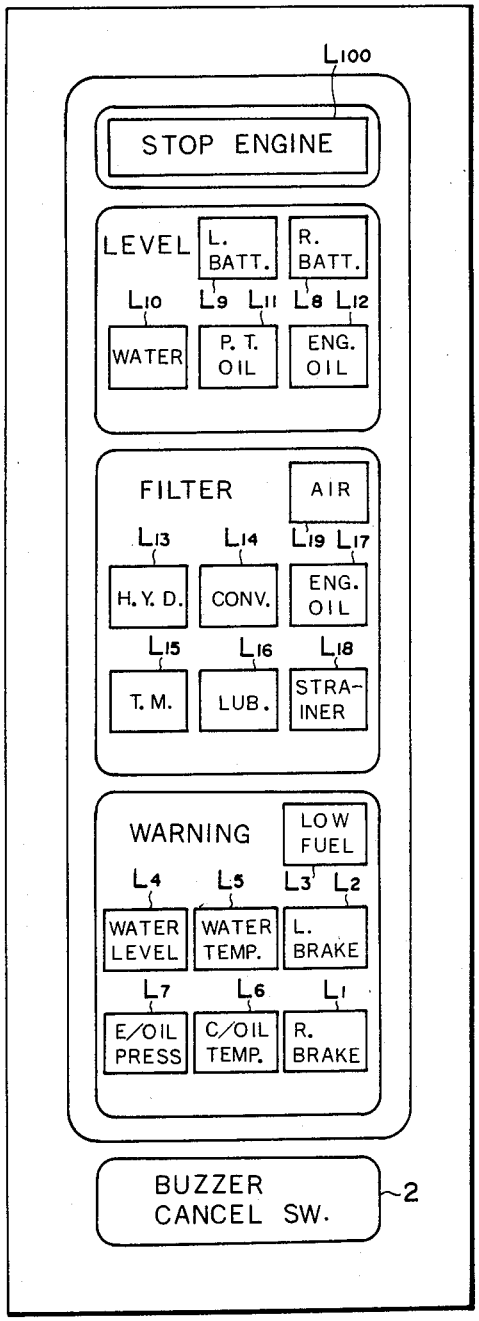
FIG. 1 is a front view showing an example of a centralized control panel for a monitoring apparatus in accordance with the present invention.

Among the accompanying drawings FIG. 1 illustrates an example of centralized display panel for a monitoring apparatus in accordance with the present invention. Specifically, the display panel includes a group of lamps effecting display by way of lighting as to whether or not the respective components including filters are properly operated at a time when inspection is performed prior to starting operation or during normal operation of a construction machine and a buzzer cancel switch 2 for serving to stop buzzing operation of a certain warning buzzer in the event that an abnormality takes place with a certain component among the aforesaid ones during the operation of the machine and then a display lamp corresponding to said warning buzzer is lighted, followed by informing activity given by the warning buzzer, said group of lamps and buzzer cancel switch 2 being located at a suitable position where an operator in a cabin on the machine can have a clear look at them and carry out his operations in the optimum manner. Among the group of lamps on the display panel lamps $L_1$ to $L_7$ undertake display lighting corresponding to watching items during the operation of the machine, lamps $L_8$ to $L_{12}$ do display lighting corresponding to inspecting items at the inspecting time prior to starting operation and Lamps $L_{13}$ to $L_{19}$ do display lighting corresponding to inspecting items relative to the filters and all the aforesaid lamps are controlled such that they are caused to flicker at every time when an abnormality is detected with respect to each of the watching and inspecting items. Further, a lamp $L_{100}$ is a stop engine lamp which is adapted to flicker when an abnormality is detected during the operation of the machine and then automatic control is initiated so as to keep an engine on the machine in an idling condition. A correlation among the respective lamps will be described in greater detail below with reference to FIGS. 2 to 10.

Figure 2:
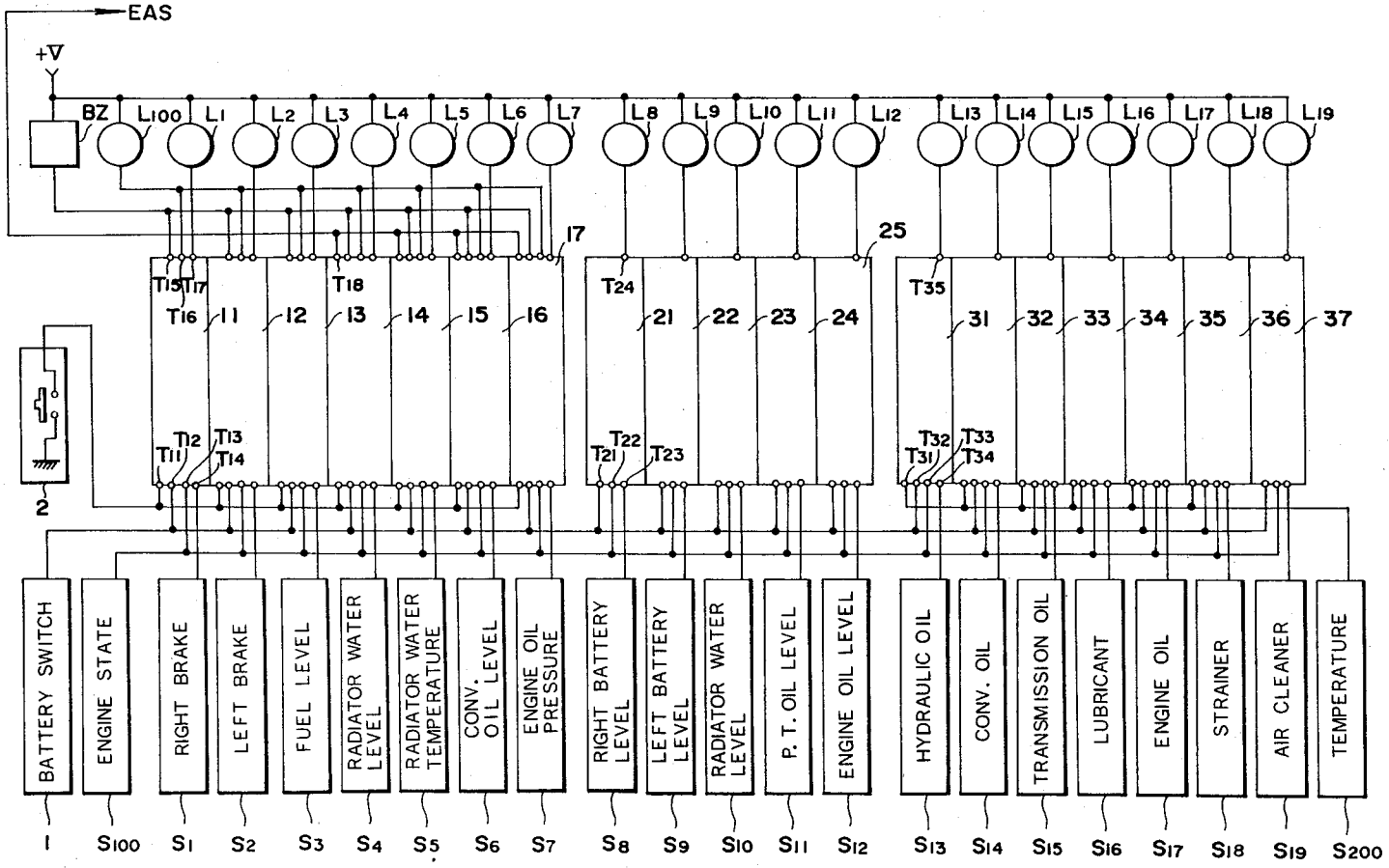
FIG. 2 is a block diagram schematically illustrating the whole structure of the monitoring apparatus in accordance with a preferred embodiment of the present invention, and FIGS. 3 to 11 schematically illustrated typical examples of the control circuits as shown on the block diagram in FIG. 2.

FIG. 2 is a block diagram schematically illustrating the whole construction of the monitoring apparatus in accordance with a preferred embodiment of the present invention.

As will be apparent from the drawing, the apparatus in accordance with the illustrated embodiment is intended to control flickering of the three groups of lamps $L_1$ to $L_7$, $L_8$ to $L_{12}$ and $L_{13}$ to $L_{19}$ corresponding to the operation watching items, the inspecting items prior to starting operation and the filter inspecting items with the aid of the three corresponding groups of control circuits 11 to 17, 21 to 25 and 31 to 37, said controlling being initiated by detecting output from the three groups of sensors $S_1$ to $S_7$, $S_8$ to $S_{12}$ and $S_{13}$ to $S_{19}$ disposed at the optimum position on the respective components corresponding to the aforesaid watching and inspecting items and that from the sensor $S_{100}$ disposed at the optimum position on the engine. It should be noted that the three groups of sensors $S_1$ to $S_7$, $S_8$ to $S_{12}$ and $S_{13}$ to $S_{19}$ are a normal closed type of sensor respectively which is designed to output a zero potential signal (which is to be treated as a logic signal and is hereinafter referred to as low level signal) when it is detected that the aforesaid watching and inspecting items are normal but output a predetermined high potential signal (which is to be treated as a logic signal and is hereinafter referred to as high level signal) when it is detected that they are not normal, whereas the sensor $S_{100}$ is another type of sensor which is designed to output a low level signal when it is detected by watching the operation of the engine that the latter stops its operation but output a high level signal when it is detected that the engine is running.

Further, when an abnormality occurs with any of the aforesaid operation watching items which are watched by means of the sensors $S_1$ to $S_7$ a certain lamp among the lamps $L_1$ to $L_7$ corresponding to them is caused to flicker and at the same time the stop engine lamp $L_{100}$ is caused to flicker while the buzzer BZ is caused to buzz. However, when an abnormality takes place with any of four operation watching items comprising a level of water in the radiator, a temperature in the radiator, a quantity of hydraulic oil contained in the torque converter and a hydraulic pressure in the engine which are adapted to be watched by means of the sensors $S_4$ to $S_7$, an engine idling signal EAS is outputted from one of the control circuits 14 to 17 whereby the engine is automatically controlled under an idling condition.

When the buzzer is caused to buzz due to an occurence of any abnormality during the operation of the machine, buzzing can be stopped by shifting the buzzer cancel switch 2 (see FIG. 1) to ON. Referring to FIG. 2 again, reference numeral 1 designates a battery switch. By shifting said battery switch 1 to ON the three groups of control circuits 11 to 17, 21 to 25 and 31 to 37 are activated for a predetermined period of time (for instance, 10 seconds in the illustrated embodiment) so as to allow all the item display lamps $L_1$ to $L_7$, $L_8$ to $L_{12}$ and $L_{13}$ to $L_{19}$ and the stop engine lamp $L_{100}$ to be lighted (in this connection it should be noted that a direct current having +V is applied to the respective lamps and the buzzer BZ by shifting the battery switch 1 to ON). Thus, checking can be effected as to whether a filament of the respective lamps as referred to above is broken or not.

Referring to FIG. 2 again, a temperature sensor $S_{200}$ is a sensor of type which is constructed such that a high level signal is outputted when it is detected that a temperature of hydraulic oil flowing through any one of the filters is, for instance, lower than 20° C. and a low level signal is outputted when it is detected that said temperature is higher than 20° C. Thus, the control circuits 31 to 37 adapted to receive output from said sensor $S_{200}$ are designed to initiate flickering of the lamps $L_{13}$ to $L_{18}$ only when an output from the sensor becomes a low level signal, that is, only when said temperature increases higher than 20° C. Further details will be described later.

The apparatus in accordance with a preferred embodiment of the present invention has been described above with respect to its whole structure and operation. Now, the aforesaid three groups of control circuits 11 to 17, 21 to 25 and 31 to 37 will be described in a greater detail below with reference to their typical example as illustrated in the accompanying drawings.

Figure 3:
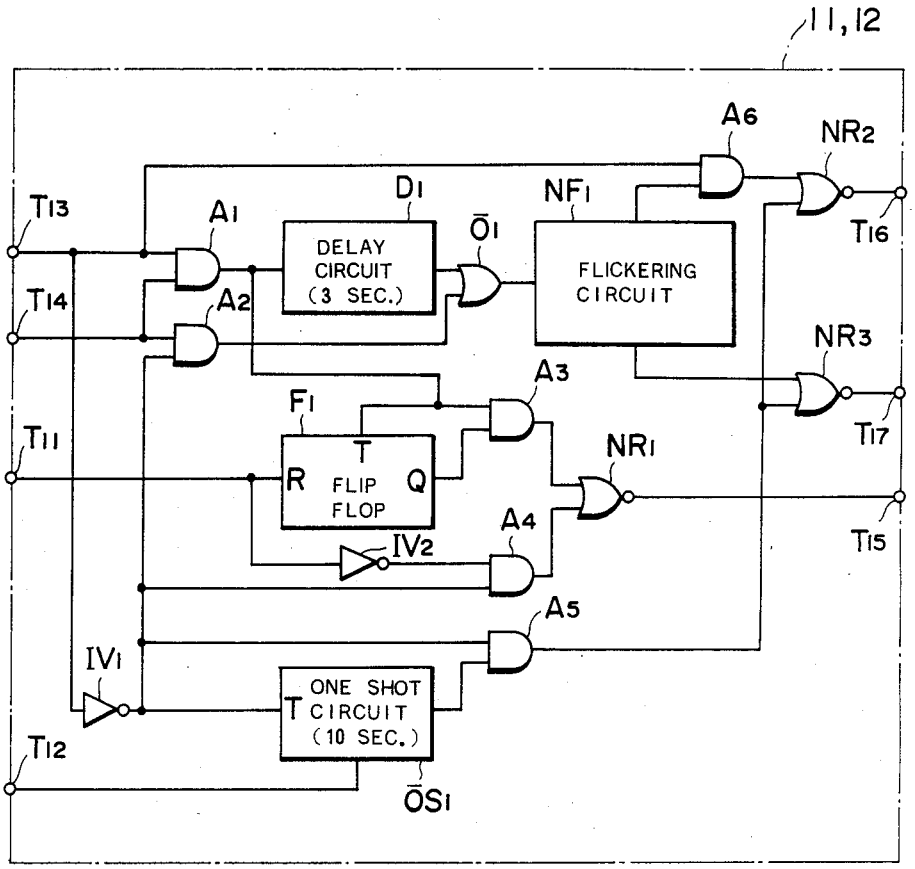

FIG. 3 schematically illustrates an example of circuit design for the control circuit 11 or 12 in which control is effected for flickering of the lamp $L_1$ or $L_2$ which is adapted to display a certain braking condition (for instance, quantity of braking liquid) at the right or left side of the machine, said braking condition being watched by means of the sensor $S_1$ or $S_2$. As is apparent also from FIG. 2, in FIG. 3 a terminal $T_{13}$ is connected to the sensor $S_{100}$, a terminal $T_{14}$ is to the sensor $S_1$ or $S_2$, a terminal $T_{11}$ is to the buzzer cancel switch 2, a terminal $T_{12}$ is to the battery switch 1, a terminal $T_{16}$ is to the stop engine lamp $L_{100}$, a terminal $T_{17}$ is to the lamp $L_1$ or $L_2$ and a terminal $T_{15}$ is to the buzzer BZ respectively.

Since an output from the sensor $S_{100}$, that is, a signal to be applied to the terminal $T_{13}$ in the illustrated circuit is a low level signal in the illustrated circuit before the engine starts its operation, an input to the one shot circuit $OS_1$ and an one way input to the AND circuit $A_5$ will have a high level signal applied thereto by way of the inverter $IV_1$ respectively. Thus, when the battery switch 1 is shifted to ON (with the terminal $T_{12}$ kept at a high level) while the above-described state is maintained, a high level signal is outputted from the one shot circuit $OS_1$ for a predetermined period of 10 seconds after completion of shifting of the battery switch 1 and a high level signal is outputted also from the AND circuit $A_5$ for a period of 10 seconds corresponding to said high level signal outputted, whereby an output from the open collector type NOR circuits $NR_2$ and $NR_3$ (herein after referred to simply as NOR circuit) becomes a low level for a period of 10 seconds and thereby the terminals $T_{16}$ and $T_{17}$ are caused to have an earth potential. Specifically, a direct current applied by shifting the battery switch 1 to ON reaches the terminal $T_{16}$ (NOR circuit $NR_2$) and the terminal $T_{17}$ (NOR circuit $NR_2$) by way of the lamp $L_{100}$ and the lamps $L_1$ and $L_2$ so that the lamp $L_{100}$ and the lamps $L_1$ and $L_2$ are lighted for a period of 10 seconds (This function is hereinafter referred to simply as lamp checking function). It should be noted that the one shot circuit $OS_1$ is reset when the battery switch 1 is shifted to OFF.

When the engine starts its operation, an output from the sensor $S_{100}$, that is, a signal to be inputted to the terminal $T_{13}$ becomes a high level signal and then it is added to one input to the AND circuit $A_1$ and an one way input to the AND circuit $A_6$. Thus, when it is detected by the sensor $S_1$ or $S_2$ that an abnormality takes place with right- or left-hand braking (quantity of hydraulic liquid) while the above-described state is maintained, an AND condition is established with respect to the AND circuit $A_1$ by the detecting signal inputted into the terminal $T_{14}$ at a high level whereby a high level signal is outputted from the AND circuit is applied to one input to the AND circuit $A_3$ and thereby a flip-flop $F_1$ connected to an other input to the AND circuit $A_3$ is set. Thus, an AND condition is established for the AND circuit $A_3$ and an output from the NOR circuit $NR_1$ becomes a low level (earthed potential) whereby the buzzer BZ connected to the terminal $T_{15}$ is caused to buzz. After initiation of the buzzer BZ is delayed for a predetermined period of time, for instance, for 3 seconds with the aid of the delay circuit D (for instance, integration circuit) said output from the NOR circuit $NR_1$ is applied to the flickering circuit $NF_1$ by way of the OR circuit $O_1$ so that the flickering circuit $NF_1$ is operated. The flickering circuit $NF_1$ is a circuit of type which is designed to output a series of flickering signals having a predetermined interval between any two successive ones, that is, a series of pulse signals having a predetermined interval (signals by which a high potential level becomes a logic high level and a low potential level becomes a logic low level) while the aforesaid high level signal is applied to the flickering circuit $NF_1$. Specifically, the flickering circuit $NF_1$ is effective in allowing an output from the NOR circuit $NR_3$ to become a low level (earthed potential) at the aforesaid predetermined interval and further allowing an output from the NOR circuit $NR_2$ to become a low level (earthed potential) at the aforesaid predetermined interval. As a result the stop engine lamp $L_{100}$ and the lamps $L_1$ and $L_2$ connected to the terminals $T_{16}$ and $T_{17}$ are caused to flicker at a time when a period of 3 seconds elapses after the buzzer BZ buzzes.

It should be noted that the buzzer BZ stops its operation by depressing the buzzer cancel switch 2 (This function is hereinafter referred to as buzzer cancel function). By depressing the buzzer cancel switch 2 the flip-flop $F_1$ is reset and then the AND condition of the AND circuit $A_3$ fails to be established whereby an output from the NOR circuit $NR_1$ becomes a high level.

Further, it is possible to carry out buzzer checking by depressing the buzzer cancel switch 2 before the engine starts its operation (This function is hereinafter referred to as buzzer checking function). Specifically, an AND condition of the AND circuit is established by means of a signal applied by way of the terminal $T_{11}$ and the inverter $IV_2$ by depressing the buzzer cancel switch 2 and a high level signal applied from the sensor $S_{100}$ by way of the terminal $T_{13}$ and the inverter $IV_1$ whereby an output from the NOR circuit $NR_1$ becomes a low level (earthed potential).

Further, as far as the right- or left-hand braking (quantity of hydraulic liquid) adapted to be watched by means of the sensor $S_1$ or $S_2$ is concerned, an arrangement is made such that before the engine starts its operation judging is effected as to whether said braking is in a good condition or not, and if it is detected that there is an abnormality with the braking before the engine starts its operation, it is informed by flickering of the lamp $L_1$ or $L_2$. In this case an AND condition of the AND circuit $A_2$ is established by means of a high level signal applied from the sensor $S_1$ or $S_2$ by way of the terminal $T_{14}$ and a high level signal applied from the sensor $S_{100}$ by way of the terminal $T_{13}$ and the inverter $IV_1$ and then the flickering circuit $NF_1$ is activated by means of a high level signal outputted from the AND circuit $A_2$. Further, in this case, since a signal applied to the AND circuit $A_6$ by way of the terminal $T_{13}$ is a low level signal, an AND condition of the AND circuit $A_6$ fails to be established and thereby only the lamp $L_1$ or $L_2$ connected to the terminal $T_{17}$ is caused to flicker.

Figure 4:
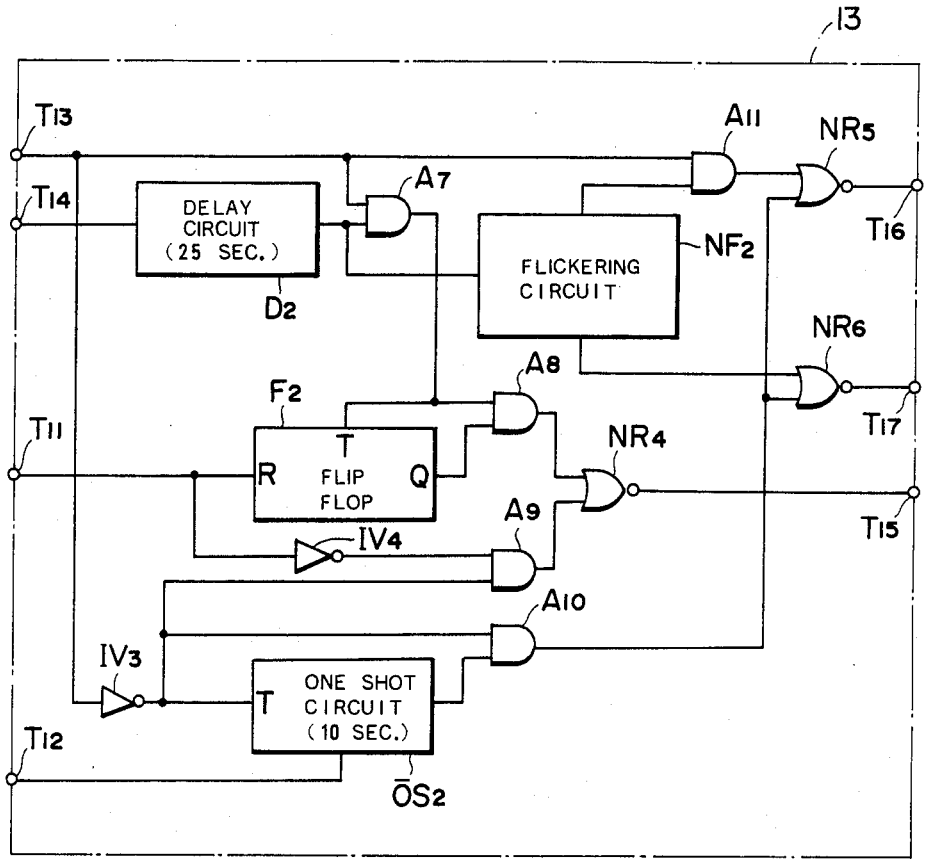

FIG. 4 schematically illustrates an example of circuit design for the control circuit 13 in which control is effected for flickering of the lamp $L_3$ which is adapted to display a residual quantity of fuel to be watched by means of the sensor $S_3$. It should be noted that connection is made for the control circuits 11 and 12 in FIG. 3 with the exception that the terminal $T_{14}$ is connected to the sensor $S_3$ and the terminal $T_{17}$ is to the lamp $L_3$.

In this control circuit 13 a lamp checking function before the engine starts its operation (function given by a combination of the one shot circuit $OS_2$, the inverter $IV_3$ and the AND circuit $A_{10}$), a buzzer checking function (function given by a combination of the inverters $IV_3$ and $IV_4$ and the AND circuit $A_9$) and a buzzer cancelling function in the event that judgment is made such that an abnormality takes place (function given by a combination of the flip-flop $F_2$ and the AND circuit $A_8$) are quite the same as those in the foregoing and therefore no repeated description will be required.

When the engine starts its operation, an output from the sensor $S_{100}$, that is, a signal to be inputted to the terminal $T_{13}$ becomes a high level signal and then it is applied to an one input to the AND circuit $A_7$ and an one input to the AND circuit $A_{11}$. Then, when it is detected by means of the sensor $S_3$ that an abnormality takes place with the residual quantity of fuel while the above-described state is maintained, initiation of a high level detecting signal to be inputted to the terminal $T_{14}$ is delayed for a predetermined period of time, for instance, for 25 seconds by means of the delay circuit $D_2$ and thereafter said detecting signal is applied to another input to the AND circuit $A_7$ so as to allow an AND condition of the AND circuit $A_7$ to be established, while it is applied to the flickering circuit $NF_2$ so as to activate the latter. As a result a high level signal outputted from the AND circuit $A_7$ becomes in effective in allowing an AND condition of the AND circuit $A_8$ to be established whereby the buzzer BZ (connected to the NOR circuit $NR_4$ by way of the terminal $T_{15}$) is caused to buzz and the flickering circuit allows the lamps $L_{100}$ and $L_3$ (connected to the NOR circuits $NR_5$ and $NOR_6$ by way of the terminals $T_{16}$ and $T_{17}$ respectively) to initiate flickering.

It should be noted that since the control circuit 13 is constructed such that judgment is made as to a detecting output from the sensor $S_3$ after a certain period of time, for instance, 25 seconds elapses, it is ensured that a definitive judgement can be made in a sufficiently reliable manner as to whether a required quantity of residual fuel is kept or not.

Further, the monitoring apparatus in accordance with the present invention is constructed such that judgement can be made before the engine starts its operation as to whether a required quantity of residual fuel is kept or not and if it is detected that an abnormality takes place therewith prior to starting operation of the engine, this is informed by flickering of the lamp $L_3$ only. This function is basicly same as that as described with respect to the control circuits 11 and 13 in FIG. 3 and therefore no repeated description will be required.

Figure 5:
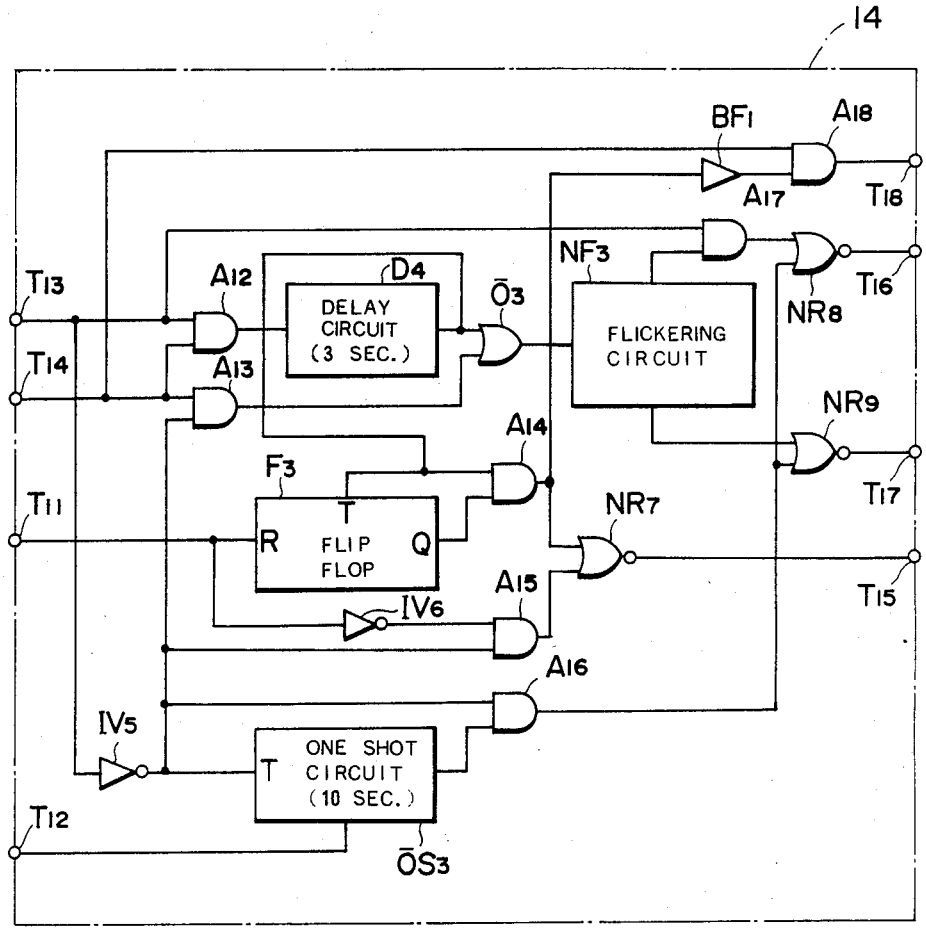

FIG. 5 schematically illustrates an example of circuit design for the control circuit 14 in which control is effected for flickering of the lamp $L_4$ which is adapted to display a water level in the radiator to be watched by means of the sensor $S_4$. It should be noted that connection is made for the control circuit 14 in the same manner as that for the control circuits 11 and 12 in FIG. 3 with the exception that the terminal $T_{18}$ is connected to a transmission line for the engine idling signal EAS, the terminal $T_{14}$ is to the sensor $S_4$ and the terminal $T_{17}$ is to the lamp $L_4$. Further, a lamp checking function before the engine starts its operation (function given by a combination of the one shot circuit $OS_3$, the inverter $IV_5$ and the AND circuit $A_{16}$) and a buzzer checking function (function given by a combination of the inverters $IV_5$ and $IV_6$ and the AND circuit $A_{15}$) or a buzzer cancelling function in the event that judgment is made such that an abnormality takes place (function given by a combination of the flip-flop $F_3$ and the AND circuit $A_{14}$) in the control circuit 14 are quitely same as those in the foregoing and therefore no repeated description will be required.

When the engine starts its operation, an output from the sensor $S_{100}$, that is, a signal to be inputted to the terminal $T_{13}$ becomes a high level signal and then it is applied to an one input to the AND circuit $A_{12}$ and an one input to the AND circuit $A_{17}$. Then, when it is detected by means of the sensor $S_4$ that an abnormality takes place with the water level in the radiator while the above-described state is maintained, this high level detecting signal to be inputted to the terminal $T_{14}$ is applied to another input to the AND circuit $A_{12}$ so as to allow an AND condition of the AND circuit $A_{12}$ to be established and it is applied also to an one input to the AND circuit $A_{18}$. Thus, initiation of a high level signal to be outputted from the AND circuit $A_{12}$ is delayed for a predetermined period of time, for instance, for 3 seconds with the aid of the delay circuit $D_4$ and thereafter said high level signal is applied to the flickering circuit $NF_3$ by way of the OR circuit $O_3$ whereby the flickering circuit $NF_3$ is activated and AND condition of the AND circuit $A_{14}$ is established. As a result the lamps $L_{100}$ and $L_4$ connected to the NOR circuit $NR_8$ and $NR_9$ by way of the terminals $T_{16}$ and $T_{17}$ are caused to flicker and the buzzer BZ connected to the NOR circuit $NR_7$ by way of the terminal $T_{15}$ initiates its buzzing. Further, since an AND condition of the AND circuit $A_{18}$ is established by way of the buffer $BF_1$, the engine idling signal EAS is outputted at a high level. This engine idling signal activated at a high level in the above-described manner is applied to an engine control apparatus as illustrated in FIG. 11 and thereby the engine is automatically kept in an idling state.

Figure 11:
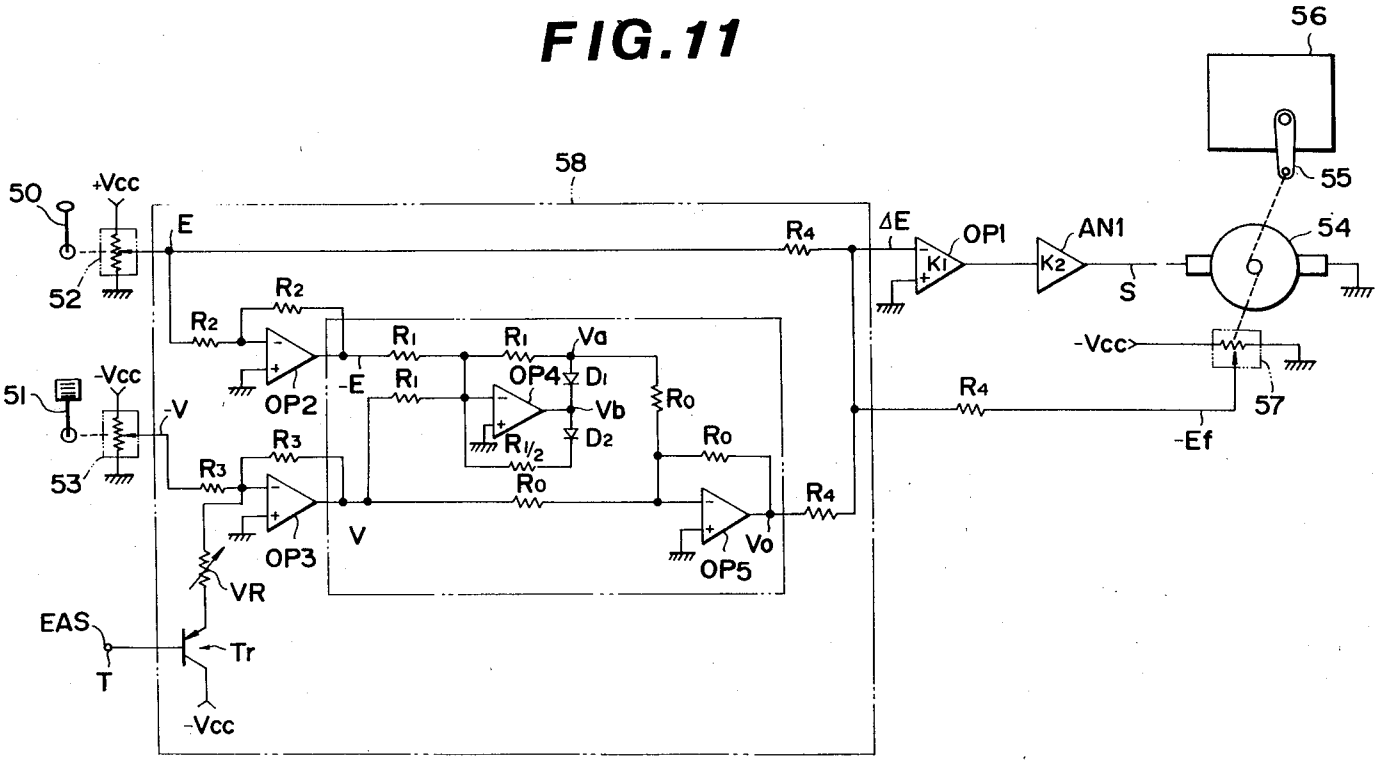

The engine control apparatus as illustrated in FIG. 11 will be briefly described below. In the drawing reference numeral 50 designates a fuel lever and reference numeral 51 does a pedal. A construction machine is normally constructed such that the fuel level 50 is normally set to a full throttle position (fully opened position) in order to ensure that an intended work is conducted with the engine kept at a full speed condition. When it is required to manually reduce rotation of the engine, control is effected by depressing the diesel pedal 51 by an operator's foot which serves to decelerate operation of the engine. Position detectors 52 and 53 are disposed to generate signals E and $-V$ corresponding to the position of the fuel lever 50 and the pedal 51. A control circuit 58 serves to generate a control signal AE corresponding to said signals E and $-V$ so as to control the rotational position of a servo motor 54. Further, a governor 56 for the engine identified by reference numeral 56 is controlled corresponding to the position of the servo motor 54. When the engine idling signal EAS is applied, the governor 55 is located at the idling position. Specifically, when the idling signal EAS is applied to an input terminal $T_r$ in the control circuit in FIG. 11, a transistor $T_r$ is turned on. A value of resistance of a variable resistor VR is determined irrespective of any value of output from the position detector 53 in such a manner that a value of output V from a processing amplifier is equal to that from a position detector E or a little bit less than the latter. As a result, when the EAS signal is applied, a value of output from the processing amplifier $OP_4$ becomes zero or positive whereby a diode $D_1$ is turned off while a diode $D_2$ is turned on. As long as a value of output from the processing amplifier $OP_4$ is zero or positive, a value of $V_a$ is kept at zero so that a processing amplifier $OP_5$ is effective merely in reversing a phase of V. Thus, an output from the processing amplifier $OP_5$ becomes $-V$ and a control signal $\Delta E$ becomes $E-V$. As a result a value of output from the control signal $\Delta E$ becomes zero or a little negative whereby the rotational position of the servo motor 54 is kept at a zero position. Thus, it is ensured that control is effected for locating the governor 55 at the idling position.

Incidentally, judgement is made with the aid of the AND circuit $A_{13}$ prior to starting operation of the engine as to whether a water level in the radiator is kept at a predetermined one or not and if it is detected that an abnormality takes place therewith prior starting operation of the engine, display is effected by way of flickering of the lamp $L_4$ only. It should be noted that the above-described functions are essentially the same as those of the control circuits described above.

Figure 6:
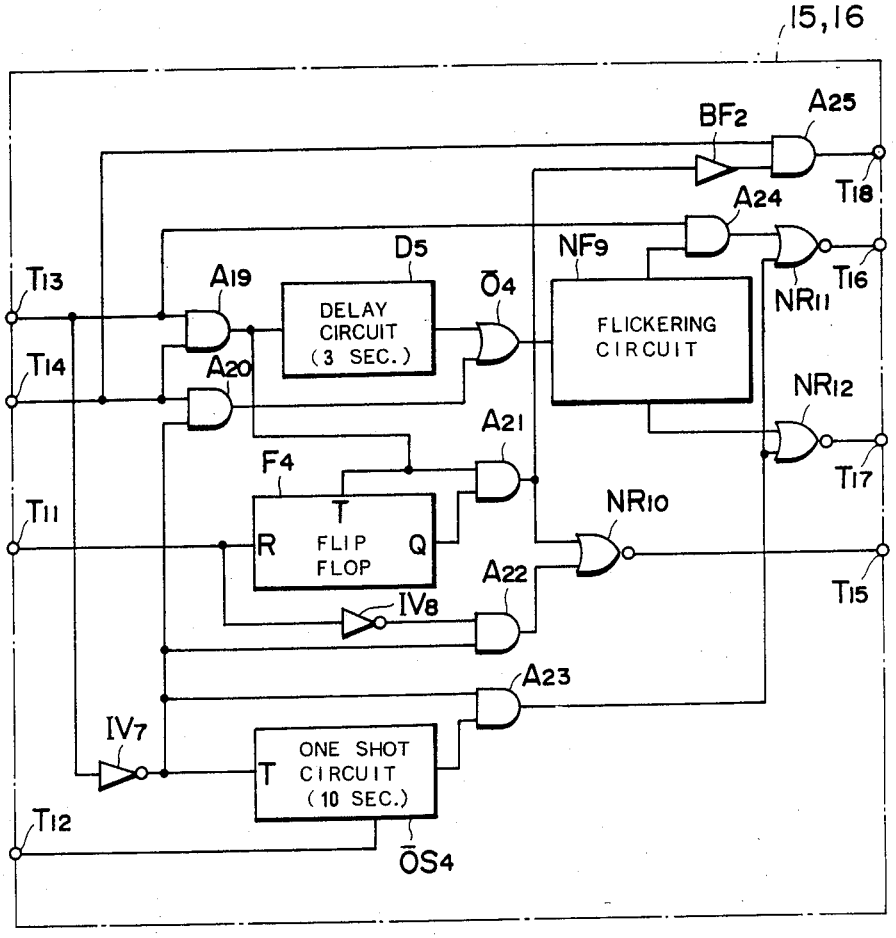

Next, FIG. 6 schematically illustrates an example of circuit design for the control circuit 15 or 16 in which control is effected for flickering of the lamp $L_5$ or $L_6$ which is adapted to display a temperature of water in the radiator to be watched by means of the sensor $S_5$ or a quantity of hydraulic oil in torque converter to be watched by means of the sensor $S_6$. It should be noted that in the control circuit 15 or 16 connection is made in the same manner as that for the control circuit 14 in FIG. 5 with the exception that the terminal $T_{14}$ is connected to the sensor $S_5$ or $S_6$ and the terminal $T_{17}$ is to the lamp $L_5$ or $L_6$. As far as the control circuit 14 is concerned, a lamp checking function prior to starting operation of the engine (function by a combination of the one shot circuit $OS_4$, the inverter $IV_7$ and the AND circuit $A_{23}$) and a buzzer checking function (function given by a combination of the inverters $IV_7$ and $IV_8$ and the AND circuit $A_{22}$) or a buzzer cancelling function in the event that judgment is made such that an abnormality takes place (function given by a combination of the flip-flop $F_4$ and the AND circuit $A_{21}$) are quite the same as those in the foregoing and therefore no repeated description will be required.

Now, when the engine starts its operation, an output from the sensor $S_{100}$, that is, a signal to be inputted to the terminal $T_{13}$ becomes a high level signal to be inputted to the terminal $T_{13}$ becomes a high level signal and then it is applied to an one input to the AND circuit $A_{19}$ and one input to the AND circuit $A_{24}$. Then, when it is detected by means of the sensor $S_5$ or $S_6$ that an abnormality takes place with a temperature of water in the radiator or a quantity of hydraulic oil in the torque converter while the above-described state is maintained, this high level detecting signal to be inputted to the terminal $T_{14}$ is applied to an other input to the AND circuit $A_{19}$ so as to allow an AND condition of the AND circuit $A_{19}$ to be established and it is applied also to an one input to the AND circuit $A_{25}$. Thus, a high level signal outputted from the AND circuit $A_{19}$ causes an AND condition of the AND circuit $A_{21}$ to be established and further initiation of said high level signal is delayed for a predetermined period of time, for instance, for 3 seconds with the aid of the delay circuit $D_5$. Thereafter, the high level signal is applied to the flickering circuit $NF_4$ by way of the OR circuit $O_4$ whereby the flickering circuit $NF_4$ is activated. As a result the buzzer BZ connected to the NOR circuit $NR_{10}$ by way of the terminal $T_{15}$ is caused to buzz and the lamps $L_{100}$ and the lamps $L_5$ and $L_6$ connected to the NOR circuits $NR_{11}$ and $NR_{12}$ by way of the terminals $T_{16}$ and $T_{17}$ initiate their flickering. Further, since an AND condition is established for the AND circuit $A_{25}$ by way of the buffer $BF_2$, the engine idling signal EAS is outputted from the terminal $T_{18}$ at a high level. This engine idling signal EAS activated at a high level is applied to the engine control apparatus as described above and thereby the engine is automatically kept in an idling state in the quite same manner as in the foregoing.

It should be noted that judgment is made with the aid of the AND circuit $A_{20}$ prior to starting operation of the engine also as to whether a temperature of water in the radiator and a quantity of hydraulic oil in the torque converter are kept at predetermined level or not and if it is detected that an abnormality takes place therewith prior to starting operation of the engine display is effected by way of flickering of the lamp $L_5$ or $L_6$ only.

Incidentally, the control circuits 15 and 16 are different from the control circuit 14 in FIG. 5 only with respect to the manner of connection relative to the delay circuit $D_5$ or $D_4$. Specifically, the control circuit 15 or 16 in which judgment is made as to whether a temperature of water in the radiator or a quantity of hydraulic oil in the torque converter is kept at a predetermined level or not is constructed in such a manner that at a time when it is confirmed that an abnormality takes place with them during operation of the engine the buzzer initiates its buzzing to issue the engine idling signal EAS and then a corresponding lamp is caused to flicker only when confirmation of the aforesaid abnormality continues for a certain period of time longer than, for instance, 3 seconds after the issuance of the engine idling signal EAS, whereas the control circuit 4 in which judgment is made as to whether a level of water in the radiator is kept at a predetermined one or not is constructed in such a manner that at a time when it is confirmed that an abnormality continues for a certain period of time longer than, for 3 seconds during operation of the engine buzzing of the buzzer, issuance of the engine idling signal EAS and flickering of a corresponding lamp are initiated at the same time. The above-described circuit design is intended to make a more reliable and definitive judgment with respect to a variety of watching items without any danger of being adversely affected by instantaneous change or fluctuation. It should be noted that the above fact is equally true to the functions of the control circuit 11 or 12 as illustrated in FIG. 3.

Figure 7:
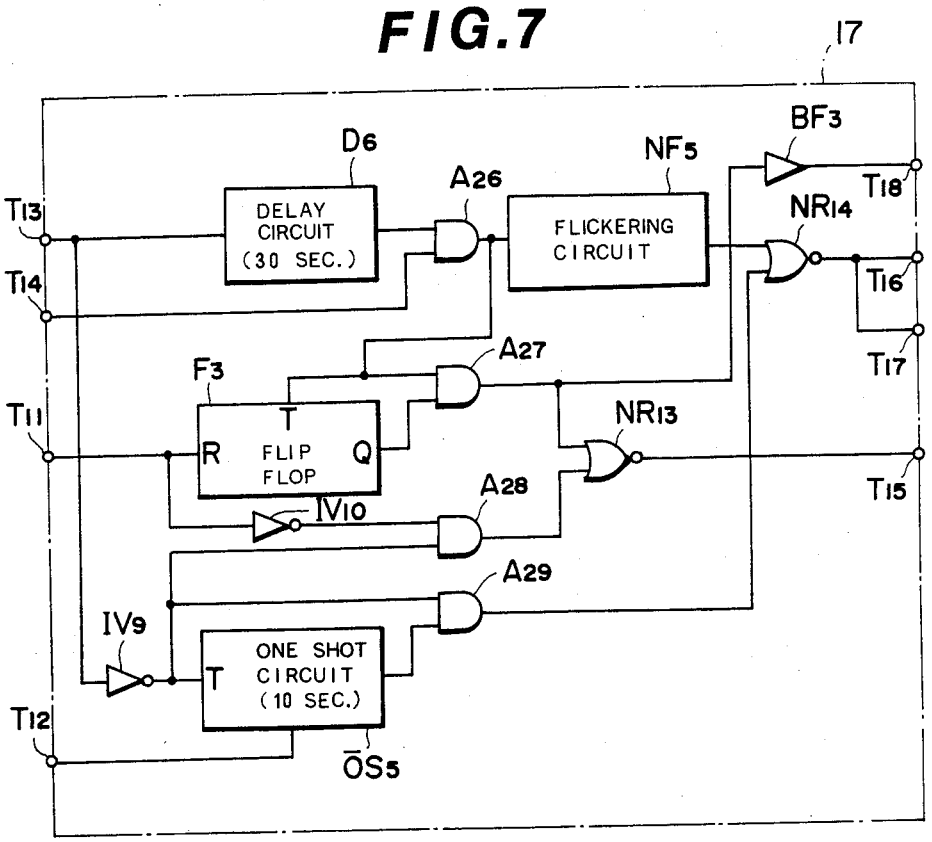

FIG. 7 schematically illustrates an example of circuit design for the control circuit 17 in which control is effected for flickering of the lamp $L_7$ which is adapted to display a hydraulic pressure in the engine to be watched by means of the sensor $S_7$. It should be noted that connection is made for the control circuit 17 in the same manner as that for the control circuit 14 in FIG. 5 with the exception that the terminal $T_{14}$ is connected to the sensor $S_7$ and the terminal $T_{17}$ is to the lamp $L_7$. Further, as far as the control circuit 17 is concerned, a lamp checking function prior to starting operation of the engine (function given by a combination of the one shot circuit $OS_5$, the inverter $IV_9$ and the AND circuit $A_{29}$) and a buzzer checking function (function given by a combination of the inverters $IV_9$ and $IV_{10}$ and the AND circuit $A_{28}$) or a buzzer cancelling function in the even that judgment is made such that an abnormality takes place (function given by a combination of the flip-flop $F_5$ and the AND circuit $A_{27}$) are quite the same as those in the foregoing and therefore no repeated description will be required.

When the engine starts its operation, an output from the sensor $S_{100}$, that is, a signal to be inputted to the terminal $T_{13}$ becomes a high level and then it is applied to the delay circuit $D_6$. After initiation of the aforesaid high level signal is delayed due to the delay circuit $D_6$ for a predetermined period of time, for instance, 30 seconds, it is further applied to the AND circuit $A_{26}$. Thus, if it is detected by means of the sensor $S_7$ at the latest at a time when 30 seconds elapse after the engine starts its operation that an abnormality takes place with a hydraulic pressure in the engine, the high level signal to be inputted to the terminal $T_{14}$ causes an AND condition to be established for the AND circuit $A_{26}$. As a result the high level signal outputted from the AND circuit $A_{26}$ is applied to the flickering circuit $NF_5$ whereby the latter is activated and at the same time an AND condition is established for the AND circuit $A_{27}$. Thus, the lamps $L_{100}$ and $L_7$ connected to the NOR circuit $NR_{14}$ by way of the terminals $T_{16}$ and $T_{17}$ respectively are caused to flicker and the buzzer BZ connected to the NOR circuit $NR_{13}$ way of the terminal $T_{15}$ initiates its buzzing. Further, the engine idling signal EAS is outputted at a high level from the terminal $T_{18}$ by way of the buffer $BF_3$. Then, this engine idling signal EAS activated at a high level is applied to the engine control apparatus as described above and thereby the engine is automatically kept in an idling state in the quitely same manner as in the foregoing.

It should be noted that the control circuit 17 is constructed such that any judgment as to whether a hydraulic pressure in the engine is kept at a predetermined level or not is prohibited by means of the delay circuit $D_6$ and the AND circuit $A_{26}$ for a certain period of time, for instance, for 30 seconds after the engine starts its operation and then the aforesaid judgment is definitively made only after the engine operation reaches a stable condition.

As described above, the control circuits 11 to 17 adapted to control monitoring display with respect to watching items to be watched by means of the sensors $S_1$ to $S_7$ during operation of the engine are designed such that judgment is made as to whether the respective watching items are acceptable or not with a certain time delay from issuance of output from the sensors, said time delay being determined properly for each of the watching items so that more definitive monitoring display is ensured.

Figure 8:
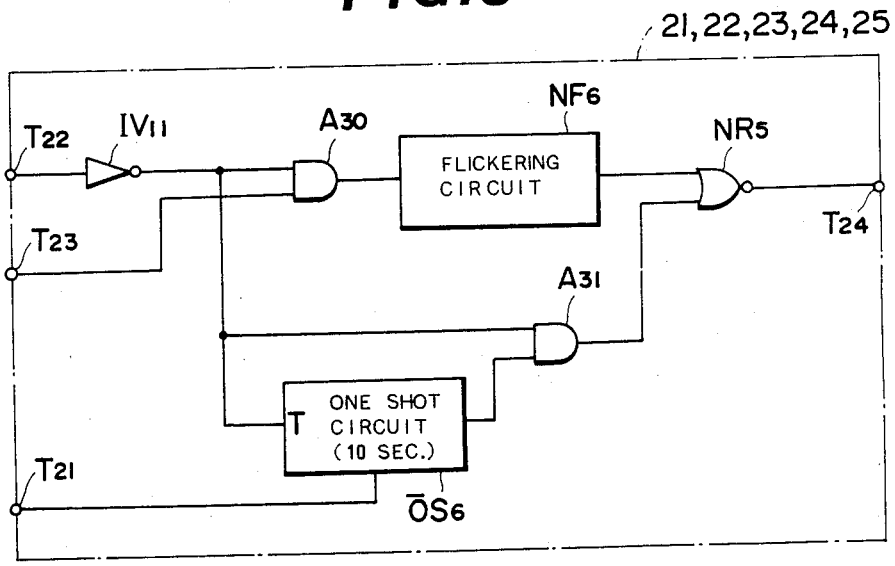

FIG. 8 schematically illustrates an example of circuit design for the control circuits 21, 22, 23, 24 and 25 in which control is effected for flickering of the lamps $L_8$ to $L_{12}$ corresponding to the inspecting items prior to starting operation to be watched by means of the sensors $S_8$ to $S_{12}$, said inspecting items comprising a quantity of liquid in the right- or left-hand battery, a level of water in the radiator, a quantity of hydraulic liquid in the power train and a quantity of hydraulic oil in the engine.

As is apparent also from FIG. 2, in FIG. 8 the terminal $T_{22}$ is connected to the sensor $S_{100}$, the terminal $T_{23}$ is to the sensors $S_8$, $S_9$, $S_{10}$, $S_{11}$ and $S_{12}$, the terminal $T_{21}$ is to the battery switch 1 and the terminal $T_{24}$ is to the lamps $L_8$, $L_9$, $L_{10}$, $L_{11}$ and $L_{12}$ respectively.

Since an output from the sensor $S_{100}$, that is, a signal to be applied to the terminal $T_{22}$ is a low level signal in the control circuits 21 to 25 before the engine starts its operation, a trigger input to the one shot circuit $OS_6$ and an one input to the AND circuit $A_{31}$ include a high level signal respectively which is applied thereto by way of the inverter $IV_{11}$. Thus, by shifting the battery switch 1 to ON (with the terminal $T_{21}$ kept at a high level) while the above-described state is maintained a high level signal is outputted from the one shot circuit $OS_6$ mereby for a predetermined period of 10 seconds since then and further a high level signal is outputted also from the AND circuit $A_{31}$ for 10 seconds corresponding to the foregoing. As a result the lamps $L_8$, $L_9$, $L_{10}$, $L_{11}$ and $L_{12}$ connected to the NOR circuit $NR_{15}$ by way of the terminal $T_{24}$ are lighted for the same period of 10 seconds (checking as to whether a filament in the lamps $L_8$ to $L_{12}$ is broken or not).

Further, when it is detected by means of the sensors $S_8$ to $S_{12}$ that an abnormality takes place with any of the aforesaid inspecting items while the above-described state is maintained, an AND condition is established for the AND circuit $A_{30}$ by means of a high level detecting signal inputted to the terminal $T_{23}$ and an output signal from the sensor $S_{100}$ activated to a high level with the aid of the inverter $IV_{11}$ whereby a high level signal outputted from the AND circuit $A_{30}$ is further applied to the flickering circuits $NF_6$, causing the latter to be activated. Thus, a specific lamp among the lamps $L_8$ to $L_{12}$ corresponding to any of the inspecting items with which an abnormality is detected initiates its flickering and then by having a look at the flickering lamp an operator can easily recognize with what item an abnormality takes place.

It should be noted that the control circuits 21, 22, 23, 24 and 25 are relieved from their abnormality judging operation as well as flickering control operation when an output from the inverter $IV_{11}$ reaches a low level after the engine starts its operation.

Figure 9:
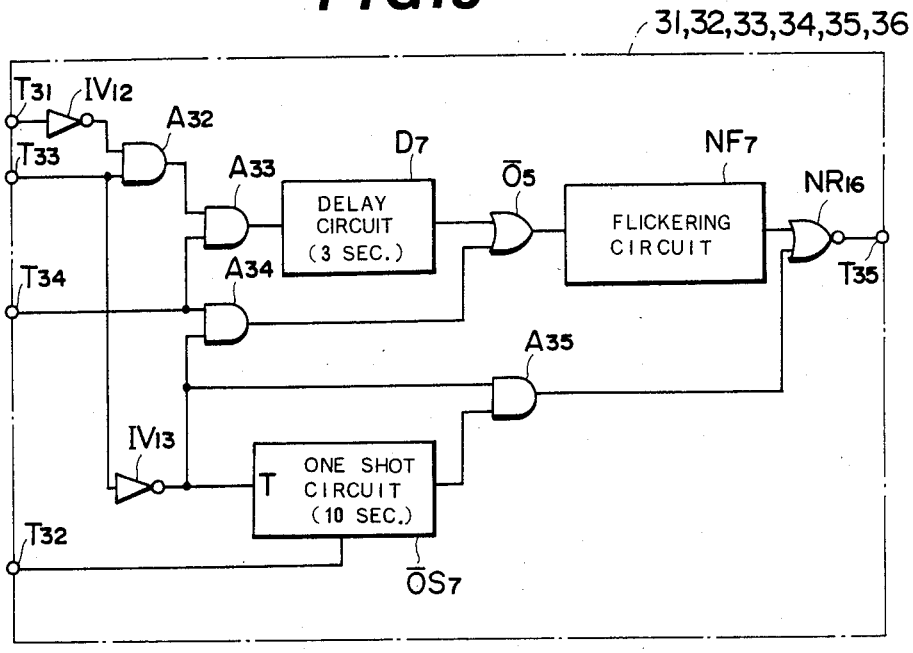

FIG. 9 schematically illustrates an example of circuit design for the control circuits 31, 32, 33, 34, 35 and 36 in which control is effected for flickering of the lamps $L_{13}$ to $L_{18}$ corresponding to the filter inspecting items to be watched by means of the sensors $S_{13}$ to $S_{18}$, said filter inspecting items comprising an operating hydraulic oil, a hydraulic oil in the torque converter, an hydraulic oil in the transmission mechanism, a lubricant, an engine oil and a strainer. As is apparent also from FIG. 2, in FIG. 9 the terminal $T_{31}$ is connected to the sensor $S_{200}$, the terminal $T_{33}$ is to the sensor $S_{100}$, the terminal $T_{34}$ is to the sensors $S_{13}$, $S_{14}$, $S_{15}$, $S_{16}$, $S_{17}$ and $S_{18}$, the terminal $T_{32}$ is to the battery switch 1 and the terminal $T_{35}$ is to the lamps $L_{13}$, $L_{14}$, $L_{15}$, $L_{16}$, $L_{17}$ and $L_{18}$. Further, a lamp checking function prior to starting operation of the engine (function given by a combination of the one shot circuit $OS_7$, the inverter $IV_{13}$ and the AND circuit $A_{35}$) in the control circuits 31 to 36 is quite the same as that described with respect to the circuits in the foregoing.

When it is detected by means of the sensors $S_{13}$ to $S_{18}$ in the control circuits 31 to 36 after the engine starts its operation that an abnormality takes place with any of the filter inspecting items while an output from the sensor $S_{200}$ becomes a low level (with an output from the inverter $IV_{12}$ kept at a high level), that is, while a temperature of any one of the aforesaid oils detected by means of the sensor $S_{200}$ is increased higher than a predetermined one, for instance, 20° C., an AND condition is established for the AND circuits $A_{32}$ and $A_{33}$. As a result initiation of a high level signal to be outputted from the AND circuit $A_{33}$ is delayed by means of the delay circuit $D_7$ for a predetermined period of time, for instance, for 3 seconds and thereafter said high level signal is applied to the flickering circuit $NF_7$ by way of the OR circuit $O_5$ whereby the flickering circuit $NF_7$ is activated. Thus, a specific lamp among the lamps $L_{13}$ to $L_{18}$ corresponding to any of the sensed items with which an abnormality is detected, said lamps $L_{13}$ to $L_{18}$ being connected to the NOR circuit $NR_{16}$ by way of the terminal $T_{35}$, initiates its flickering and then by having a look at the flickering lamp the operator can easily recognize with what filter an abnormality takes place.

It should be noted that the arrangement made such that control is effected for flickering of the lamps $L_{13}$ to $L_{18}$ in the control circuits only when a temperature of way of the aforesaid hydraulic oils is increased higher than 20° C. is intended so as not to receive any wrong detecting signal from the sensors $S_{13}$ to $S_{18}$ at a lower temperature where hydraulic oil has an increased viscosity, that is, a high level signal adapted to display that clogging occurs in spite of the fact that no clogging occurs with any of the filters at present (in this connection it should be noted that the sensors $S_{13}$ to $S_{18}$ are constructed such that they normally watch a differential pressure between both input and output pressure to and from the filters and output a high level signal which informs that an abnormality (clogging) takes place when the differential pressure exceeds, for instance, 1 $Kg/cm^2$. In view of the fact that the differential pressure between both input and output pressures to and from the filters increases at a lower temperature where hydraulic oil has an increased viscosity there is an increased possibility that incorrect judgment is made by means of the sensors $S_{13}$ to $S_{18}$.)

It should be noted that judgment is made by means of the AND circuit $A_{34}$ as to whether the aforesaid respective watching items are acceptable or not, as long as the engine does not start its operation.

Figure 10:
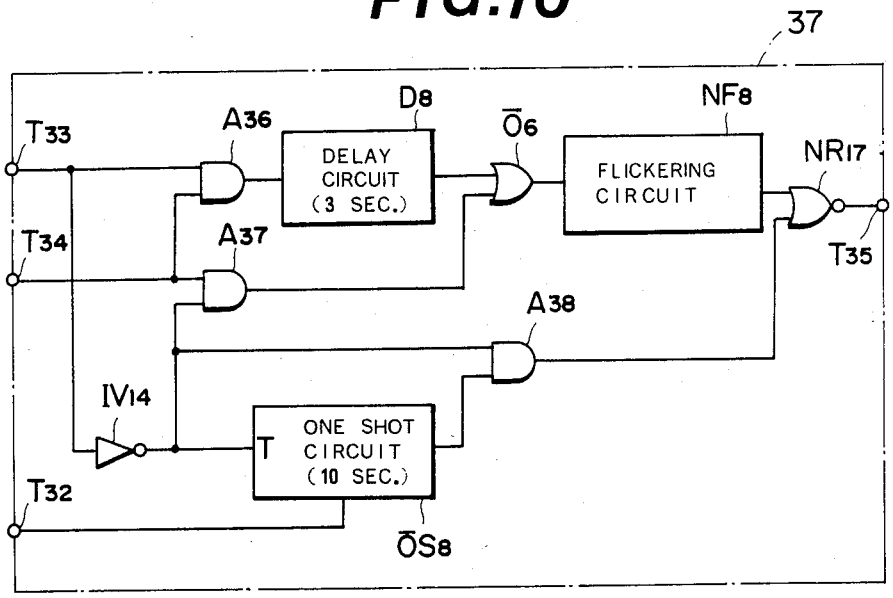

FIG. 10 schematically illustrates an example of circuit design for the control circuit 37 in which control is effected for flickering of the lamp $L_{19}$ relative to the air cleaner which is one of the filter inspecting items, said air cleaner being watched by means of the sensor $S_{19}$. It should be noted that connection is made for the control circuit 37 in the same manner as that for the control circuits 31, 32, 33, 34, 35 and 36 in FIG. 9 with the exception that the terminal $T_{34}$ is connected to the sensor $S_{19}$, the terminal $T_{35}$ is to the lamp $L_{19}$ and the terminal $T_{31}$ is removed from the control circuit 37. This means that the control circuit 37 does not require the temperature sensor $S_{200}$. Further, as far as the control circuit 37 is concerned, a lamp checking function prior to starting operation of the engine (function given by a combination of the one shot circuit $OS_8$, the inverter $IV_{14}$ and the AND circuit $A_{38}$) is quite the same as that in the foregoing and therefore no repeated description will be required.

When the engine starts its operation, a high level signal is added to an one input to the AND circuit $A_{36}$ by way of the terminal $T_{33}$ in the control circuit 37. Further, if it is detected by means of the sensor $S_{19}$ that an abnormality takes place with the air cleaner while the above-described state is maintained, the AND circuit $A_{36}$ causes an AND condition to be established. As a result a high level signal is outputted from the AND circuit $A_{36}$ and then after initiation of said high level signal is delayed by means of the delay circuit $D_8$ for a predetermined period of time, for instance, for 3 seconds, the high level signal is applied to the flickering circuit $NF_8$ by way of the OR circuit $O_6$ whereby the flickering circuit $NF_8$ is activated. Thus, the lamp $L_{19}$ (connected to the NOR circuit $NR_{17}$ by way of the terminal $T_{35}$) starts its flickering.

It should be noted that judgment is made by means of the AND circuit $A_{37}$ as to whether the air cleaner is correctly maintained or not, as long as the engine does not start its operation.

Owing to the fact that the sensor $S_{200}$, the sensors $s_{13}$ to $S_{19}$, the item lamps $L_{13}$ to $L_{19}$ and the control circuits 31 to 37 are provided for the filters it is ensured that an operator can definitively recognize whether the respective filters are properly maintained or not. Particularly, an arrangement is made such that a temperature of hydraulic oil flowing through the filters is detected by means of the sensor $S_{200}$ and judgment is made as to whether the filters are clogged or not only when said temperature is increased to a predetermined one. Thus, an excellently high monitoring accuracy is ensured.

It should be noted that if a period of time which elapses until a temperature of hydraulic oil is increased to the predetermined one (for instance, 20° C.) after the engine starts its operation can be previously estimated to some extent, the control circuit as illustrated in FIG. 9 may be modified in such a manner that it is equipped with a suitable timer circuit (delay circuit) which is designed so as to allow a judgment timing to be delayed by the aforesaid period of time. Specifically, with respect to the watching items with which there is a certain relation between temperature and time an arrangement may be made such that the delay circuit is replaced with a temperature sensor.

It should be of course understood that the predetermined period of time for the delay circuit and the predetermined temperature for the temperature sensor as defined above with reference to the examples of circuit design for the respective control circuits are merely illustrative and thus they may be properly determined, taking into account required watching items and a working environment where a construction machine is operated.

Further, the control circuits may be equipped with analogue processing circuit, microcomputer or the like, if the latter is capable of satisfactorily practicing the aforesaid functions.

Finally, it should be added that a monitoring display device should be not limited only to the lamps as described above and any other type of monitoring display means may be employed, if it is proven that it is properly operated.

What is claimed is:

1. A monitoring apparatus for a construction machine essentially comprising:

engine operation/stop detecting means for detecting if an engine is in a stopped or operating state to issue a signal of one level when the engine is in the stopped state and a signal of the other level when the engine is in its operating state;

a plurality of sensors for detecting abnormality states in said engine other than stop and operation, and in auxiliary equipments of the construction machine;

a plurality of display means; and a plurality of control circuits, each associated with a respective one of said plurality of sensors, and each receiving an output of said engine operation/stop detecting means, for flickering said display means beginning after an individually selectable lapse of time after an abnormality occurs and is detected by the associated sensor; and means for immediately causing said engine to idle upon said detection of abnormality occurrence and before said lapse of time.

2. The monitoring apparatus as set forth in claim 1, wherein some of said plurality of control circuits cause said display means to flicker and a buzzer to sound when said abnormality states are detected, said some of the control circuits comprising a buzzer cancelling switch connected thereto and a buzzer cancelling circuit for causing the sounding buzzer to stop sounding.

3. The monitoring apparatus as set forth in claim 1 further comprising a battery switch, wherein said control circuits comprise a one shot circuit for lighting said display means for a predetermined period of time starting from the operation of said battery switch.

4. The monitoring apparatus as set forth in claim 1, wherein said control circuits are a circuit for issuing an abnormal state signal to said display means immediately when the engine is in the stop state and with a predetermined time delay when the engine is in the operating state.

5. A monitoring apparatus for a construction machine comprising:

a plurality of sensors disposed at predetermined inspecting positions on the construction machine to detect whether or not an abnormality takes place at said inspecting positions, displaying means for visually displaying an occurrence of the abnormality in accordance with a detection output from the sensors, inhibiting means for inhibiting said display of the abnormality by said displaying means for a certain period of time that elapses until a stable condition is attained at the inspecting positions, and further including;

means for generating an idling signal on the basis of the detected output from the sensors when it is detected that an abnormality takes place at the inspecting positions, said idling signal causing an engine mounted on the construction machine to be kept in an idling state, said idling signal being generated before said certain period of time.

6. A monitoring apparatus for a construction machine as defined in claim 5, wherein said inhibiting means comprises a timer circuit.

7. A monitoring apparatus for a construction machine as defined in claim 6, wherein said timer circuit is an integration circuit.

8. A monitoring apparatus for a construction machine having an engine comprising:

sensing means for detecting abnormality conditions at one or more predetermined inspecting positions;

warning display means responsive to said sensing means for providing an engine idling signal and a visual display in accordance with detected abnormality condition, said engine idling signal causing the engine to idle; and delay means, cooperating with said warning display means, for causing the warning display means to activate the visual display only if the abnormality condition continues for a predetermined time after issuance of said engine idling signal, said engine idling signal being provided without delay upon detection of an abnormality condition.

9. A monitoring apparatus according to claim 8 further comprising:

a control circuit for said engine, said circuit causing said engine to decelerate in accordance with a control signal input from a lever or pedal on said construction machine, said engine idling signal overriding said control signal to cause said control circuit to decellerate said engine to an idling condition regardless of the position of said lever or pedal.

* * * * *